US006159172A

United States Patent [19]

Gray et al.

[11] Patent Number: 6,159,172

[45] **Date of Patent: *Dec. 12, 2000**

[54] ORTHOPEDIC SEAT WITH INFLATABLE CELLS

[75] Inventors: Gary Gray, Adrian; David J. DeVries, Walker; David G. Goulooze, Hudsonville, all of Mich.

[73] Assignee: Sand Therapeutic, Inc., Hudsonville, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,318

[22] Filed: Aug. 23, 1996

Related U.S. Application Data

[60] Provisional application No. 60/002,826, Aug. 25, 1995, abandoned.

[51] Int. Cl.[7] ..... A61H 7/00

[52] U.S. Cl. ..... 601/149; 601/148; 601/55; 601/61; 601/150; 5/710; 5/713; 5/709; 5/933; 297/452.41

[58] Field of Search ..... 601/148, 55, 61, 601/149, 150; 5/710, 713, 709, 933, 653, 654; 297/452.41, DIG. 3

[56] References Cited

U.S. PATENT DOCUMENTS

| | | | |
|---|---|---|---|
| 1,147,560 | 7/1915 | Shurtleff et al. . | |
| 1,795,304 | 3/1931 | Howard | 297/DIG. 3 X |
| 2,245,909 | 10/1941 | Enfiajian | 601/148 |
| 2,528,843 | 11/1950 | Poor . | |
| 2,531,074 | 11/1950 | Miller . | |
| 2,684,672 | 7/1954 | Summerville | 601/148 |
| 2,819,712 | 1/1958 | Morrison | 601/148 |
| 3,148,391 | 9/1964 | Whitney . | |
| 3,196,868 | 7/1965 | Johnston . | |
| 3,270,440 | 9/1966 | Radosevic, Jr. . | |
| 3,326,601 | 6/1967 | Vanderbilt et al. . | |
| 3,477,071 | 11/1969 | Emerson . | |
| 3,492,988 | 2/1970 | De Mare . | |
| 3,613,671 | 10/1971 | Poor . | |
| 3,760,801 | 9/1973 | Borgeas . | |
| 3,770,315 | 11/1973 | Smittle et al. . | |
| 3,867,732 | 2/1975 | Morrell . | |
| 4,175,297 | 11/1979 | Robbins et al. . | |
| 4,178,923 | 12/1979 | Curlee . | |
| 4,524,762 | 6/1985 | Schulman . | |
| 4,555,140 | 11/1985 | Nemoto | 297/452.41 X |
| 4,583,522 | 4/1986 | Aronne | 601/149 |
| 4,634,179 | 1/1987 | Hashimoto et al. . | |
| 4,703,750 | 11/1987 | Sebastian et al. . | |
| 4,707,027 | 11/1987 | Horvath et al. . | |
| 4,796,948 | 1/1989 | Paul et al. . | |
| 4,840,425 | 6/1989 | Noble . | |
| 4,915,124 | 4/1990 | Sember, III . | |
| 4,981,131 | 1/1991 | Hazard . | |
| 5,022,385 | 6/1991 | Harza . | |
| 5,113,540 | 5/1992 | Sereboff | 297/452.41 X |
| 5,163,737 | 11/1992 | Navach et al. | 297/DIG. 3 X |
| 5,243,722 | 9/1993 | Gusakov | 297/DIG. 3 X |
| 5,378,045 | 1/1995 | Siekman et al. | 297/452.41 X |
| 5,395,162 | 3/1995 | Jay et al. | 297/452.41 X |
| 5,461,741 | 10/1995 | Graebe | 297/452.41 X |
| 5,490,299 | 2/1996 | Dinsmoor, III et al. | 297/452.41 X |

FOREIGN PATENT DOCUMENTS

| | | |
|---|---|---|
| 7806327 | 6/1978 | Netherlands . |

*Primary Examiner*—Danton D. DeMille
*Attorney, Agent, or Firm*—Rader, Fishman, Grauer & McGarry, an office of Rader, Fishman & Grauer, PLLC

[57] ABSTRACT

A passive-motion having a support surface provided by a plurality of bellows-like or bladder-like cells which are sequentially or independently inflatable and deflatable to alter the configuration of the support surface continuously to cause a person seated on the support surface to continuously and instinctively adjust the additude of his spinal column and associated muscles.

15 Claims, 3 Drawing Sheets

ORTHOPEDIC SEAT WITH INFLATABLE CELLS

This application claims the benefit of U.S. provisional patent application Ser. No. 60/002,826, filed Aug. 25, 1995 now abandoned.

BACKGROUND OF THE INVENTION

1. Field of the Invention

This invention relates to a passive-motion orthopedic seat, and more particularly, to a passive-motion orthopedic seat having a support surface adapted to be continuously reconfigured, thereby causing a person seated on the support surface to continuously and instinctively adjust the attitude of his spinal column and associated muscles.

2. Related Prior Art

Many occupations require the worker to remain in virtually the same seated position or attitude for prolonged periods. While this has always been so in the case of sedentary workers confined to a fixed work station, the number of such workers has increased enormously in the modern era with the rapid evolution of technology and the concomitant institution of highly efficient systems of production of both goods and services. The computer terminal and the personal computer, now ubiquitous in private life and home employment as well as in the traditional workplace, are notorious for anchoring their users in a chair for hours at a time, confronting a keyboard in an upright posture. Without realizing it, such a user tends to maintain one posture rigidly for long periods without adjusting the attitude of his spinal column and associated muscles.

It is therefore hardly surprising that such workers, and hobbyists as well in many instances, increasingly complain of back pain of varying degrees of frequency and intensity, some of it so severe as to be disabling. Although a great variety of adjustable chairs have been devised to enhance the comfort of such persons, the chairs are usually adjustable only with regard to the height or angle of the seat and the angle of the backrest and do not address the problems created by rigidly maintaining the same seated attitude for extended periods.

Exercises are often prescribed as therapy by medical professionals for the relief or correction of back conditions, chronic or temporary, but their patients or clients tend to neglect to perform such exercises regularly because of the physical effort and concentration required. There is therefore a need for a passive exerciser, ideally a passive-motion orthopedic seat, which may be employed by the patient or client to realize the benefits of the therapy without consciously exerting noticeable physical effort and while carrying out some other activity.

Various expedients have been proposed for automatically moving bodily parts between positions or attitudes. For example, in U.S. Pat. No. 5,197,461, issued Mar. 30, 1993 to J. H. Petajan et al., there are described and illustrated a series of orthopedic pillows, each of which is specifically configured to receive and conform to a particular, individual bodily limb or extremity. When the limb or extremity is placed to rest upon it, the pillow is cyclically inflated and deflated by means of a pump to cause the limb or extremity to be repeatedly raised and lowered for therapeutic purposes. The cycle of inflation and deflation is governed, not by time-actuated means, but by a pressure-sensitive switch. Clearly, the patient undergoing such therapy is expected to be entirely passive and relaxed throughout the treatment. The Petajan patent is representative of a body of such art, which also includes U.S. Pat. No. 3,477,071, issued Nov. 11, 1969 to J. H. Emerson, and U.S. Pat. No. 3,492,988, issued Feb. 3, 1970 to B. L. De Maré.

U.S. Pat. No. 5,022,385 issued Jun. 11, 1991 to R. D. Harza, is directed to a method and a device for periodically and rhythmically raising first one hip of a seated person and then the other to simulate the muscle stimulation and relaxation which would be imparted through walking. More particularly, Harza provides a seat section which is limited to only two inflatable cells, one to be positioned directly under the left hip of the seated person and the other to be positioned directly under the right hip. To achieve the simulated walking motion, Harza inflates and deflates the two cells alternately.

U.S. Pat. No. 3,270,440, issued Sept. 6, 1966 to T. Radosevic, Jr., discloses a seat having a bottom cushion formed of three independently inflatable cells of equal size and shape and aligned in a row from right to left. However, the Radosevic, Jr. patent is directed to a flight simulator, and thus the internal pressure in each of the cells is variously increased and decreased, not according to a predetermined program, but directly in response to a seated person's manipulation of controls similar to those provided in aircraft, whereby to simulate the feeling of the motions which result from performance of various aircraft maneuvers.

U.S. Pat. No. 4,840,425, issued Jun. 20, 1989 to R. H. Noble, discloses a seating assembly comprising alternating sets of elongated inflatable compartments that extend across a seat and backrest, each set independently supporting a seated person when pressurized to a degree greater than the other set. A control mechanism acts to alternately inflate and partially deflate each set, with inflation occurring from the rear of the seat portion forwardly and from the bottom of the backrest upwardly.

A somewhat similar device is disclosed in U.S. Pat. No. 3,867,732, issued Feb. 25, 1975 to W. C. Morrell, and another, directed specifically to therapeutic massage, is disclosed in U.S. Pat. No. 3,613,671, issued Oct. 19, 1971 to J. H. Poor et al.

SUMMARY OF THE INVENTION

The present invention provides a passive-motion orthopedic seat having a support surface adapted to be continuously reconfigured, whereby to cause a person seated on the support surface to continuously and instinctively adjust the attitude of his spinal column and associated muscles. More particularly, the support surface is provided by a plurality of bellows-like or bladder-like cells which are sequentially or independently inflatable and deflatable to alter the configuration of the support surface continuously. Ingress and egress of a gas, suitably air, to and from the cells may be governed by pressure-sensitive switches, as in the aforementioned patent to Petajan et al., or by mechanically actuated valves, or by time-sensitive means according to a predetermined program.

A cushion of, say, foamed elastomeric material, or simply a sealed, gas-filled cushion may be provided in each cell or as an overlay or underlay of the support surface to maintain comfort when the respective cell is in the deflated condition.

The beneficial effect of the seat may be augmented by providing one or more bellows-like bladders disposed at the rear of the seat to engage the extreme lower back of a seated person, such bladders being inflatable and deflatable, much in the manner of the cells forming the support surface.

These and other objects, features and advantages of the invention will be apparent from the ensuing description in conjunction with the accompanying drawings.

THE DRAWINGS

THE PREFERRED EMBODIMENTS

Figure 1:
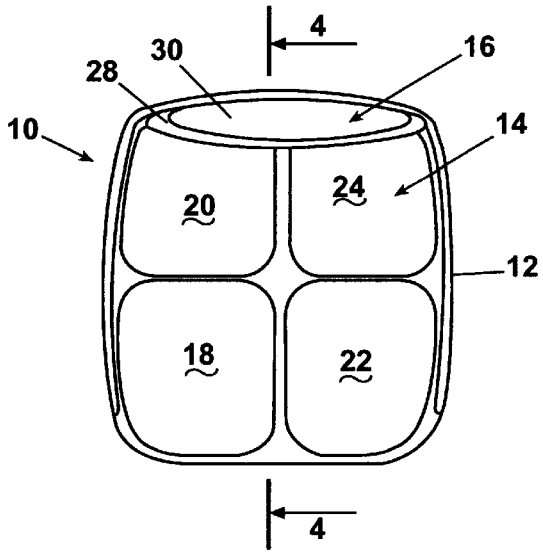
FIG. 1 is a plan view of a passive-motion orthopedic seat according to the invention and comprising a first embodiment thereof.
Figure 2:
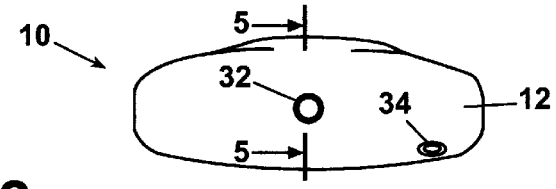
FIG. 2 is a rear elevational view of the seat of FIG. 1.
Figure 3:
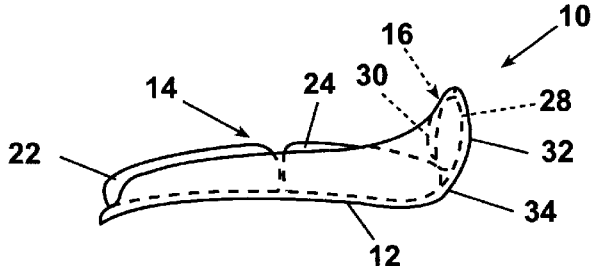
FIG. 3 is a side elevational view of the seat of FIGS. 1 and 2.

Referring particularly to FIGS. 1 to 3, there is shown a first embodiment of a passive-motion orthopedic seat 10 according to the invention, which comprises a cover or shell 12, a support surface indicated generally at 14, and a lower-back support 16.

Shell 12 may be formed of any rigid or semirigid material and may take one of any number of configurations adapting it to be incorporated in a chair (not shown) or a prefabricated work module. Preferably, the shell is vacuum-formed or rotation-molded of synthetic resinous material in thicknesses sufficient to bear the weight of a seated adult of ordinary weight and stature.

Support surface 14 is adapted to be engaged by the posterior of such a person and is made up of the combined upper surfaces of a plurality of inflatable bellows-like cells. Four such cells are included in the embodiment depicted, namely a right-front cell 18, a right-rear cell 20, a left-front cell 22, and a left-rear cell 24.

The cells are suitably vacuum-formed of a substantially nonelastic, flexible material impermeable by gases—a vinyl sheet material for example—and are affixed to the shell at their bases by any suitable means, such as radio-frequency welding or adhesives. If desired, they may collectively be enclosed by a flexible cover (not shown) for aesthetic purposes and ease of cleaning.

Figure 4:
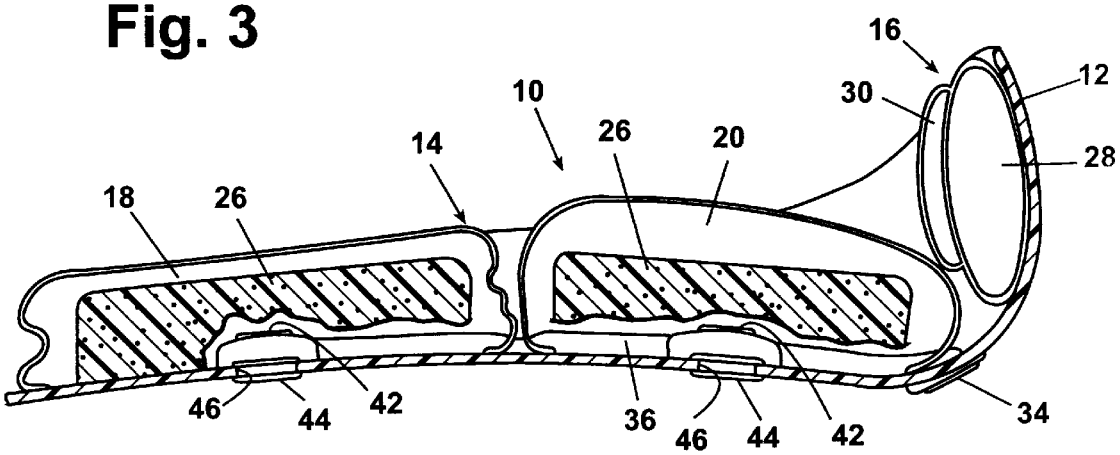
FIG. 4 is an enlarged, longitudinal sectional view of the seat of FIGS. 1 to 3, taken along line 4—4 of FIG. 1.

Referring to FIG. 4, a resiliently compressible cushion 26 is preferably enclosed within each of the inflatable cells and affixed to shell 12 to maintain the comfort of a seated person by bearing a proportion of his weight when the respective cell is in a deflated condition. The cushion suitably comprises a foamed elastomer. It is to be noted in FIG. 4 that right-front cell 18 is shown in a partially inflated condition and that right-rear cell 20 is shown in the fully inflated condition.

Figure 5:
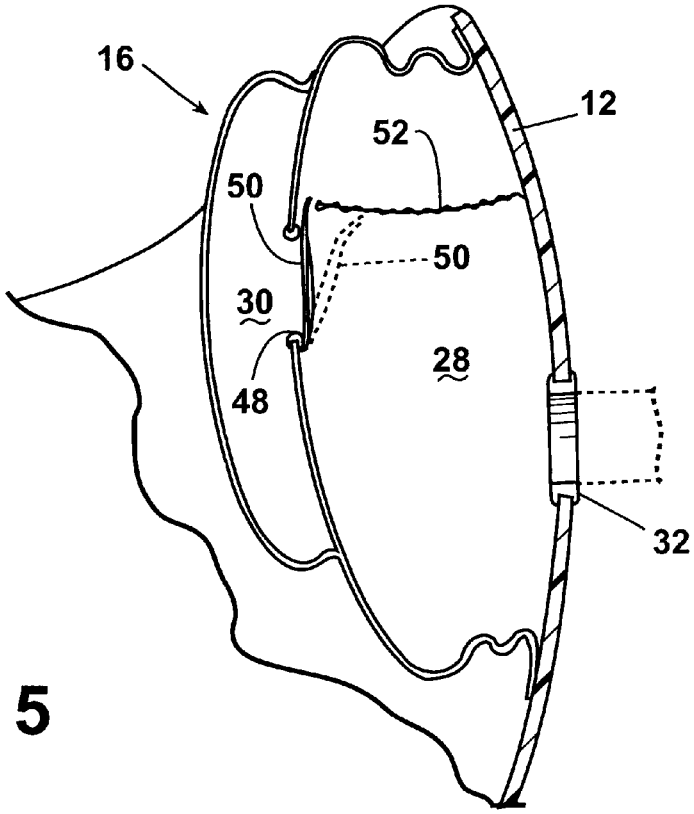
FIG. 5 is a partial, longitudinal sectional view of the seat of FIGS. 1 to 4, showing a rear portion thereof and taken along line 5—5 of FIG. 2.

With particular reference to FIGS. 4 and 5, lower-back support 16 comprises a pair of inflatable bellows-like bladders 28 and 30 formed of the material of the inflatable cells or a similar material. Bladder 28 is the larger of the two and, like each of the cells, is affixed at its base to shell 12, as by radio-frequency welding or adhesives. Bladder 30 is smaller and is affixed at its base to the outer surface of bladder 28 in a similar manner. The bladders are so disposed on the shell as to engage the extreme lower back of a person properly seated on support surface 14. In FIG. 5, bladder 28 is shown in a partially inflated condition, while bladder 30 is shown in its fully inflated condition.

Seat 10 is so constructed that the interiors of cells 18, 20, 22, and 24 and bladders 28 and 30 may be placed in communication with a source of gas under pressure, such as a pump (not shown), for inflation. For these purposes, shell 12 is provided with a pair of gas fittings 32 and 34 communicating respectively with the interior of bladder 28 and the interiors of the inflatable cells.

Figure 6:
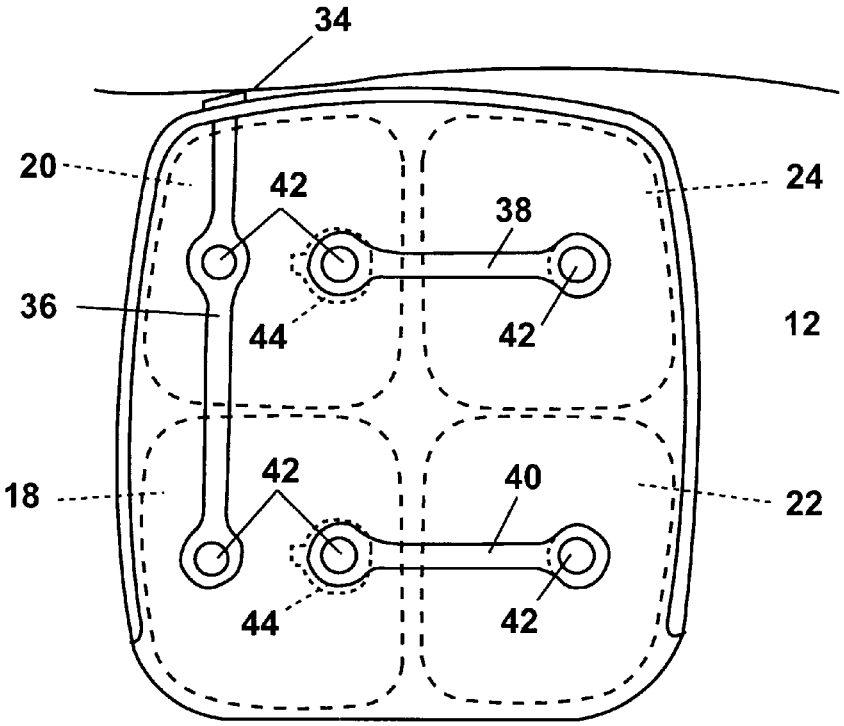
FIG. 6 is a bottom plan view of the seat of FIGS. 1 to 5, showing the seat with upper elements thereof removed to reveal a preferred arrangement of certain internal elements.

Disregarding for a moment the specific example shown in FIGS. 4 and 6, one or more pressure-sensitive switches (not shown) may be interposed between the pump and gas fittings 32 and 34. These switches may suitably take the form of the air switches and other switching and control means described and illustrated in the aforementioned patent to Petajan et al. Alternative devices and arrangements will readily suggest themselves to persons of ordinary skill in the art.

By way of example, a simple mechanical system is shown schematically in FIGS. 4 and 6, which system includes an inlet passage 36 extending from gas fitting 34 to cells 20 and 18, respectively, a first transfer passage 38 extending from cell 20 to cell 24, and a second transfer passage 40 extending from cell 18 to cell 22. Inlet valves 42, responsive to various predetermined pressure levels to open and close, are provided for inflating the cells sequentially. Exhaust valves 44, also responsive to predetermined pressure levels, are seated in exhaust ports 46 formed in shell 12, for deflating the cells. (Only two exhaust valves are indicated in FIG. 6, these being represented by interrupted lines in relation to cells 18 and 20, respectively, but each of cells 22 and 24 would be similarly outfitted with an exhaust valve and port.)

Referring to FIG. 5, bladder 28 is inflated and deflated by way of gas fitting 32 and air switching means (not shown). Bladder 30 is inflated and deflated by way of a transfer port 48 formed in bladder 28. A transfer valve 50 is normally in a position closing transfer port 48, as shown in solid lines, but is moved to its open position, shown in interrupted lines, when bladder 28 is inflated, by the action of a tether 52 interconnecting the transfer valve and the shell, as shown, and, when bladder 28 is deflated, by the now-positive pressure differential between the interiors of bladder 30 and bladder 28.

More particularly, it will be seen that, as bladder 28 is inflated, the tension of the tether is increased until it acts to move transfer valve 50 to the open position, whereupon bladder 30 will be inflated. As bladder 28 is deflated (as by way of a pressure-sensitive air switch in communication with gas fitting 32), and a predetermined pressure differential arises between the interiors of the bladders, the pressure acting on transfer valve 50 will cause it to open, thereby permitting bladder 30 to be deflated. It will also be noted that engagement of the bladders with the lower back of a seated person will affect the internal pressures of the bladders.

Whatever means are employed for inflating and deflating the cells and the bladders, it is the method of the invention to continuously reconfigure the support surface 14 by differentially inflating and deflating the cells, sequentially or independently, and thus to continuously redistribute the weight of a seated person about the support surface. This will cause him instinctively and continuously to adjust the attitude of his spinal column and associated muscles. This effect is augmented by the continuous inflation and deflation of bladders 28 and 30, to exert varying pressure on the extreme lower back of the seated person, again to cause him to adjust his upright attitude.

Noting that cells 18 and 24 are offset from each other in two mutually perpendicular directions and that cells 20 and 24 are also offset from each other in two mutually perpendicular directions, the benefits of the invention might be realized, however less perfectly, if only cell 18 and cell 24 were provided to continuously reconfigure support surface 14 or, alternatively, if only cell 20 and cell 22 were provided. Providing any three of the four cells would, of course, represent an improvement over the two-cell versions just mentioned, but would nevertheless fall short of the four-cell version fully described hereinabove and illustrated in FIGS. 1 to 6.

Figure 9:
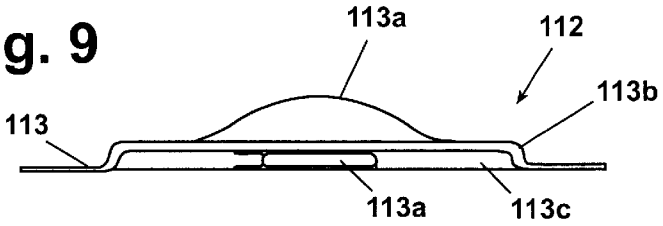
FIG. 9 is a rear elevational view of the shell of FIG. 8.
Figure 8:
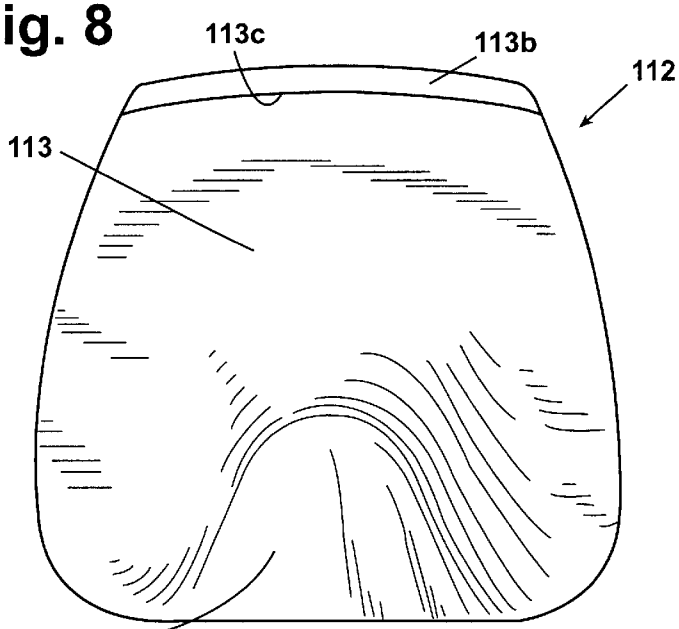
FIG. 8 is a plan view of a shell suitable for use with the bladder element of FIG. 7 in the second embodiment of the invention.
Figure 10:
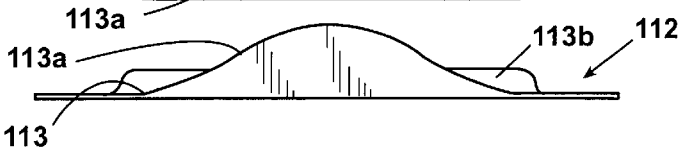
FIG. 10 is a front elevational view of the shell of FIGS. 8 and 9.
Figure 7:
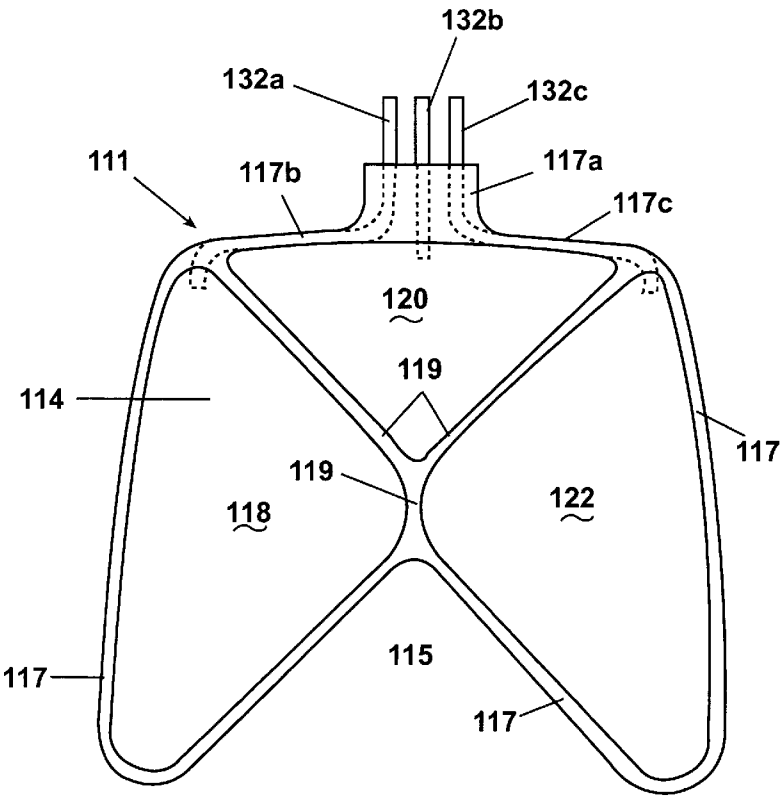
FIG. 7 is a plan view of a bladder element of a passive-motion orthopedic seat according to the invention and comprising a second embodiment thereof.

However, turning now to FIGS. 7 to 10, there are shown the principal elements of a second embodiment of a passive-motion orthopedic seat according to the invention, which does indeed employ only three cells, as described hereinbelow. More particularly, FIG. 7 shows a bladder element 11 having a support surface indicated generally at 114, and FIGS. 8 to 10 show a shell 112.

Shell 112 may be formed by the same methods and of the same materials as those employed in the manufacture of shell 12, as described hereinabove. The configuration of shell 112 is similar to that of much conventional seating, and in this regard includes an upper weight-bearing surface 113 generally complementary to the weight-bearing portions of a seated human body.

Weight-bearing surface 113, however, includes at its front or forward end a sizable central hump 113*a* formed to be received comfortably beneath or between the inner portions of the upper thighs of a properly seated person. The hump ensures that any departure from proper seating will be signaled by mild discomfort. Proper seating; that is, proper orientation of the body relative to the seat, while desirable under any circumstances for orthopedic reasons as well as long-term comfort, is necessary in connection with a seat comprising the elements shown in FIGS. 7 to 10 if the seat is to perform its function to the fullest extent.

A rearwardly hollow, upstanding lip 113*b* is provided at the rearward end of weight-bearing surface 113. A forward wall 113*c* of lip 113*b* is formed with a central aperture 113*d*.

Bladder element 111 is formed to overlie shell 112 in engagement with weight-bearing surface 113 thereof and with support surface 114 uppermost. Thus, in plan as shown, the perimeter of bladder element 111 generally follows that of shell 112 but is provided with an indentation 115 to accommodate hump 113*a* of the shell.

The bladder element comprises three inflatable bladder-like cells, namely a right cell 118, a rear cell 120, and a left cell 122, the perimeter of each cell generally describing an isosceles triangle, indentation 115 being of similar form, the apices of the triangles described by the perimeters of the cells and by the indentation being proximate one another as is apparent in FIG. 7.

Bladder element 111 comprises two sheets of substantially nonelastic, flexible material impermeable by gases, which are sealed together, as by heat, radio-frequency welding or adhesives, at their common edges and between the cells to form an edge seal 117 and inner boundary seals 119 which together act to isolate the interiors of the cells from the ambient and from one another. Simultaneously with or after the forming of the seals, the bladder element is trimmed to the outline shown in FIG. 7.

Three gas conduits 132*a*, 132*b*, 132*c*, formed of any suitable flexible tubing, provide passages for the ingress and egress of inflating gas, such as air, to the interiors of cells 118, 120 and 122, respectively, whereby each of the cells may be inflated and deflated entirely independently of the others. An expanded portion or manifold 117*a* of edge seal 117 encloses portions of all three gas conduits, while edge seal portions 117*b* and 117*c* enclose additional portions of gas conduits 132*a* and 132*c*, respectively, to conduct them to the interiors of cells 118 and 122. Alternative conduit arrangements will readily suggest themselves to the person of skill in the art.

Bladder element 11 and shell 112 are assembled by inserting manifold 117*a* through aperture 113*d* formed in lip 113 until the rear edge of the bladder element abuts the forward wall 113*c* of the lip and the bladder element rests on weight-bearing surface 113 with hump 113*a* received in indentation 115. (Aperture 113*d* will provide a passage for the gas conduits whether or not they are gathered or assembled together as by manifold 117*a*.) A fitted flexible cover (not shown) is then placed over the shell and the bladder element to enclose them and hold them in place. The cover may be made of any suitable upholstery material. A pad or cushion (also not shown), suitably formed of a resilient sheet foamed material, suitably elastomeric, and cut to match the outline of the bladder element, may be disposed between the shell and the bladder element or between the cover and the bladder element for comfort when any one or more of the cells is completely deflated.

The outer ends of conduits 132*a*, 132*b*, 132*c* are connected to any suitable gas control system adapted to introduce gas under pressure independently to each of the cells by way of its respective conduit and to exhaust gas from each inflated cell by way of the same conduit. This is done according to preselected sequences, inflation rates, deflation rates, and interval timing and may be accomplished by assembling a combination of any of various well-known pumps, valve systems, and controls. Control devices capable of instituting virtually any cycle of inflation and deflation of one or more cells are available and may be programmed by the user or her medical professional to treat or alleviate specific muscular or skeletal conditions. As noted above in connection with the embodiment of FIGS. 1 to 6, any number of such devices and arrangements will readily suggest themselves to persons of ordinary skill in the art.

Here again, it should be emphasized that whatever means are employed for inflating and deflating the cells and the cells, it is the method of the invention to continuously reconfigure the support surface 114 by differentially inflating and deflating the cells 118, 120, 122, sequentially, or in overlapping timing, or entirely independently of one another. This will continuously redistribute the weight of a seated person to cause her to continuously adjust the attitude of her spinal column and associated muscles.

Cells 118 and 120 being offset from each other in two mutually perpendicular directions, as are cells 120 and 122, it will be noted that the benefits of the invention might be realized to some extent if only cell 118 and cell 120 were provided to continuously reconfigure support surface 114 or, alternatively, if only cell 120 and cell 122 were provided.

While the invention has been described with reference to specific embodiments thereof, it will be understood that this is by way of illustration and not of limitation and that the scope of the appended claims should be construed as broadly as the prior art will permit.

What is claimed is:

1. A passive-motion orthopedic seat for causing a person seated thereon to continuously adjust the attitude of the seated person's spinal column and associated muscles, comprising first second and third discrete inflatable cells forming a surface adapted to support the posterior of a seated person, each of the second and third cells being adjacent to the first cell, the first cell being situated rearwardly relative to a seated person, the second cell being situated forwardly of the first cell and laterally thereof in one direction, the third cell being situated forwardly of the first cell and laterally thereof in a direction opposite to said one direction, and a passage system comprising first, second and third gas conduits, each of the gas conduits at one end thereof opening outwardly of the seat and communicating with the interior of a respective one of the cells for introducing a gas thereto and evacuating the gas therefrom independently of the passage of gas to and from the interior of the other cells to separately inflate and deflate the cells according to a predetermined program, whereby to permit the support surface to be continuously reconfigured.

2. A seat according to claim 1, wherein the cells are provided in a unitary bladder element formed of flexible material and having sealed portions isolating the cells from the ambient and from one another.

3. A seat according to claim 2, including a relatively rigid shell for supporting the bladder element thereon.

4. A seat according to claim 3, wherein the shell is formed with a central hump at the forward end thereof relative to a seated person, the bladder element being formed with an indentation at the forward end thereof to accommodate the hump.

5. A seat according to claim 4, wherein the respective perimeters of the cells generally conform respectively to the sides of first, second and third isosceles triangles having apices directed inwardly of the bladder element and situated proximately of one another.

6. A seat according to claim 5, wherein the outline of the indentation conforms generally to the sides of a fourth isosceles triangle having an apex directed inwardly of the bladder element and situated proximately to the apices of the first, second and third triangles.

7. A seat according to claim 6, wherein the shell is formed with an upstanding lip at the rearward end thereof relative to a seated person, the lip forming an abutment cooperating with the hump to orient the bladder element relative to the shell.

8. A seat according to claim 7, wherein the lip is formed with an aperture providing a passage for the gas conduits.

9. A passive-motion orthopedic seat for causing a person seated thereon to continuously adjust the attitude of the seated person's spinal column and associated muscles, comprising at least three discrete inflatable cells forming a surface adapted to support the posterior of a seated person, and a passage system opening outwardly of the seat and communicating with the interior of each of the cells individually for introducing a gas thereto and evacuating the gas therefrom independently of the passage of gas to and from the interior of the other of the cells to separately inflate and deflate the cells according to a predetermined program, whereby to permit the support surface to be continuously reconfigured, the passage system comprising a gas fitting opening to the exterior of the seat and adapted to be connected to a source of gas, a first passage communicating with the gas fitting and the interior of each of first and second ones of the cells, first and second inlet ports communicating with the first passage, each of the first and second inlet ports opening into the interior of a respective one of the first and second cells, first and second pressure-actuated valves, each thereof being associated with a respective one of the first and second inlet ports to control flow of gas therethrough from the first passage to the interior of the respective cell, a second passage interconnecting the interiors of the first cell and a third one of the cells, a third inlet port communicating with the second passage and opening into the interior of the third cell, a pressure-actuated third valve associated with the third inlet port to control flow of gas therethrough from the second passage to the interior of the third cell, first, second and third outlet ports, each thereof communicating with the exterior of the seat and the interior of a respective one of the cells, and pressure-actuated fourth, fifth and sixth valves, each thereof being associated with a respective one of the outlet ports to control flow of gas therethrough from the interior of the respective cell to the exterior of the seat.

10. A passive-motion orthopedic seat for causing a person seated thereon to continuously adjust the attitude of the seated person's spinal column and associated muscles, comprising at least three discrete inflatable cells forming a surface adapted to support the posterior of a seated person, and a passage system opening outwardly of the seat and communicating with the interior of each of the cells individually for introducing a gas thereto and evacuating the gas therefrom independently of the passage of gas to and from the interior of the other of the cells to separately inflate and deflate the cells according to a predetermined program, whereby to permit the support surface to be continuously reconfigured, the passage system comprising a gas fitting opening to the exterior of the seat and adapted to be connected to a source of gas, a first passage communicating with the gas fitting and the interior of each of first and second ones of the cells, first and second inlet ports communicating with the first passage, each of the first and second inlet ports opening into the interior of a respective one of the first and second cells, first and second pressure-actuated valves, each thereof being associated with a respective one of the first and second inlet ports to control flow of gas therethrough from the first passage to the interior of the respective cell, a second passage interconnecting the interiors of the first cell and a third one of the cells, a third inlet port communicating with the second passage and opening into the interior of the third cell, a pressure-actuated third valve associated with the third inlet port to control flow of gas therethrough from the second passage to the interior of the third cell, a third passage interconnecting the interiors of the second cell and a fourth one of the cells, a fourth inlet port communicating with the third passage and opening into the interior of the fourth cell, a pressure-actuated fourth valve associated with the fourth inlet port to control flow of gas therethrough from the third passage to the interior of the fourth cell, first, second, third and fourth outlet ports, each thereof communicating with the exterior of the seat and the interior of a respective one of the cells, and pressure-actuated fifth, sixth, seventh and eighth valves, each thereof being associated with a respective one of the outlet ports to control flow of gas therethrough from the interior of the respective cell to the exterior of the seat.

11. A seat according to claim 10, wherein the first and third cells are situated rearwardly relative to a seated person and laterally adjacent to each other, the second and fourth cells being situated forwardly of the first and third cells relative to a seated person and laterally adjacent to each other with the second cell also adjacent to the first cell and the fourth cell also adjacent to the third cell, whereby the fourth cell is situated diagonally from the first cell and the second cell is situated diagonally from the third cell.

12. A passive-motion orthopedic seat for causing a person seated thereon to continuously adjust the attitude of the seated person's spinal column and associated muscles, comprising at least three discrete inflatable cells forming a surface adapted to support the posterior of a seated person, a passage system opening outwardly of the seat and communicating with the interior of each of the cells individually for introducing a gas thereto and evacuating the gas therefrom independently of the passage of gas to and from the interior of the other of the cells to separately inflate and deflate the cells according to a predetermined program, whereby to permit the support surface to be continuously reconfigured, the cells being formed of flexible material and individually mounted on a relatively rigid shell, and a plurality of cushions formed of foamed material and corresponding to the cells in number, each of the cushions being supported by the shell within a respective one of the cells.

13. A passive-motion orthopedic seat for causing a person seated thereon to continuously adjust the attitude of the seated person's spinal column and associated muscles, comprising at least three discrete inflatable cells forming a surface adapted to support the posterior of a seated person, and a passage system opening outwardly of the seat and communicating with the interior of each of the cells individually for introducing a gas thereto and evacuating the gas therefrom independently of the passage of gas to and from the interior of the other of the cells to separately inflate and deflate the cells according to a predetermined program, whereby to permit the support surface to be continuously reconfigured, the passage system comprising a plurality of gas conduits corresponding to the cells in number, each of the conduits at one end thereof opening outwardly of the seat and at the other end thereof opening into the interior of a respective one of the cells for independently introducing a gas thereto and evacuating the gas therefrom, the cells being provided in a unitary bladder element formed of flexible material and having sealed portions isolating the cells from the ambient and from one another, the cells comprising first, second and third individual cells, each of the second and third cells being adjacent to the first cell, the first cell being situated rearwardly relative to a seated person, the second cell being situated forwardly of the first cell and laterally thereof in one direction, the third cell being situated forwardly of the first cell and laterally thereof in a direction opposite to said one direction.

14. A seat according to claim 13, including a relatively rigid shell for supporting the bladder element thereon.

15. A seat according to claim 14, wherein the shell is formed with a central hump at the forward end thereof relative to a seated person, the bladder element being formed with an indentation at the forward end thereof to accommodate the hump.

* * * * *

UNITED STATES PATENT AND TRADEMARK OFFICE

CERTIFICATE OF CORRECTION

PATENT NO.: 6,159,172

DATED: December 12, 2000

INVENTOR(S): Gary Gray et al.

It is certified that error appears in the above-identified patent and that said Letters Patent are hereby corrected as shown below:

Claim 1, column 7, line 8, "first" should be "first,".

Signed and Sealed this

Eighth Day of May, 2001

*Attest:*

Nicholas P. Godici

NICHOLAS P. GODICI

*Attesting Officer*

*Acting Director of the United States Patent and Trademark Office*